US009057291B2

(12) United States Patent
Jeon et al.

(10) Patent No.: US 9,057,291 B2
(45) Date of Patent: Jun. 16, 2015

(54) VARIABLE VALVE LIFT DEVICE AND VALVE APPARATUS FOR VEHICLE ENGINE USING THE SAME

(71) Applicant: Hyundai Motor Company, Seoul (KR)

(72) Inventors: Jae Hee Jeon, Whasung-Si (KR); Gi Ra Lee, Whasung-Si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/089,008

(22) Filed: Nov. 25, 2013

(65) Prior Publication Data

US 2014/0182528 A1 Jul. 3, 2014

(30) Foreign Application Priority Data

Dec. 28, 2012 (KR) ..... 10-2012-0157503

(51) Int. Cl.

| | |
|---|---|
| ***F01L 1/34*** | (2006.01) |
| ***F01L 1/18*** | (2006.01) |
| ***F01L 1/26*** | (2006.01) |
| ***F01L 13/00*** | (2006.01) |

(52) U.S. Cl.

CPC ..... *F01L 1/181* (2013.01); *F01L 1/267* (2013.01); *F01L 13/0015* (2013.01); *F01L 2001/186* (2013.01); *F01L 2013/0094* (2013.01)

(58) Field of Classification Search

CPC ..... F01L 1/181; F01L 1/267; F01L 13/0015; F01L 2013/0094; F01L 2001/186

USPC ..... 123/90.16, 90.39

See application file for complete search history.

(56) References Cited

U.S. PATENT DOCUMENTS

| | | | | |
|---|---|---|---|---|
| 4,917,056 | A * | 4/1990 | Yagi et al. | 123/90.16 |
| 5,107,803 | A * | 4/1992 | Furnivall | 123/90.16 |
| 7,493,879 | B2 * | 2/2009 | Fujii et al. | 123/90.16 |

FOREIGN PATENT DOCUMENTS

| | | | |
|---|---|---|---|
| JP | 6-58117 | A | 3/1994 |
| KR | 10-2011-0032658 | A | 3/2011 |
| KR | 10-2012-0032343 | A | 4/2012 |

* cited by examiner

*Primary Examiner* — Zelalem Eshete

(74) *Attorney, Agent, or Firm* — Morgan, Lewis & Bockius LLP

(57) ABSTRACT

A variable valve lift device and a valve apparatus for a vehicle engine may include a valve configured to open/close a combustion chamber, a cam having a predetermined cam profile and rotatable by receiving a power generated in the combustion chamber, a cam side rocker arm rotatable by the cam, a rocker shaft penetratively mounted into the cam side rocker arm, a valve side rocker arm installed on the rocker shaft to apply a pressure for opening the valve while being turned by the cam side rocker arm, a hydraulic interval adjustment device installed in the cam side rocker arm to adjust an interval between the cam side rocker arm and the valve side rocker arm, and a hydraulic interval maintaining device configured to maintain the interval between the cam side rocker arm and the valve side rocker arm adjusted by the hydraulic interval adjustment device.

14 Claims, 11 Drawing Sheets

VARIABLE VALVE LIFT DEVICE AND VALVE APPARATUS FOR VEHICLE ENGINE USING THE SAME

CROSS-REFERENCE TO RELATED APPLICATION

The present application claims priority of Korean Patent Application Number 10-2012-0157503 filed Dec. 28, 2012, the entire contents of which application are incorporated herein for all purposes by this reference.

BACKGROUND OF INVENTION

1. Field of Invention

The present invention relates to a variable valve lift device and a valve apparatus for a vehicle engine using the same, and more particularly, to a variable valve lift device and a valve apparatus for a vehicle engine using the same, which allow high lift modes and low lift modes of intake and exhaust valves to be implemented by two rocker arms operated by hydraulic pressure.

2. Description of Related Art

In general, in an engine of a vehicle, a combustion chamber configured to generate power by combusting fuel is provided, and a valve train is provided which includes an intake valve, which controls an inflow of air, or a mixture of air and fuel which flows into the combustion chamber, and an exhaust valve which controls an outflow of exhaust gas discharged from the combustion chamber.

In addition, the combustion chamber is opened and closed while the intake and exhaust valves of the valve train are operated by a cam which is moved together with rotational motion of a crankshaft rotated by receiving power generated by the combustion of fuel.

As the cam is formed to have a predetermined profile, the intake and exhaust valves always have a predetermined lift value, and an amount of inflow and outflow of air and exhaust gas, which flows into and out of the combustion chamber through the intake and exhaust valves, are set to be a predetermined amount in accordance with the lift value of the cam.

When the lift values of the intake and exhaust valves are appropriately adjusted in accordance with an operational state of an engine for a vehicle, fuel efficiency and output of the engine may be increased, and therefore a variable valve lift device configured to adjust the lift value of intake and exhaust valves in accordance with an operational state of the engine is being proposed.

The variable valve lift device may be classified into a hydraulic device or a mechanical device based on an operational power source, and in a case of the hydraulic variable valve lift device, a structurally improved method is necessary which may increase valve lift loads, and improve operational reliability.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a variable valve lift device and a valve apparatus for a vehicle engine using the same having advantages of improving fuel efficiency and output torque of an engine by smoothly implementing high lift modes and low lift modes of intake and exhaust valves while being operated by hydraulic pressure.

Various aspects of the present invention provides a variable valve lift device including: a first rocker arm coupled to a turning center shaft and rotatable about the turning center shaft, a second rocker arm coupled to the turning center shaft and rotatable about the turning center shaft, a hydraulic interval adjustment device installed in the first rocker arm to adjust an interval between the first and second rocker arms, and a hydraulic interval maintaining device configured to maintain the interval between the first and second rocker arms adjusted by the hydraulic interval adjustment device.

The first rocker arm may include an upper body having a substantially quadrangular block shape, two flanges integrally formed and extended downwardly from the upper body and spaced apart from each other at a predetermined interval to form an assembly space, a roller inserted into the assembly space and rotatably mounted in the two flanges, and two assembly portions integrally formed and extended downwardly from the upper body, wherein the turning center shaft penetratively fits into the two assembly portions.

The second rocker arm may include an arm body having an assembly hole for penetratively fitting the turning center shaft into the assembly hole, an extension portion integrally formed and extended outwardly from the arm body in a crossing direction, and a pressure receiving portion having a substantially quadrangular block shape and formed on an upper portion of the extension portion to receive a pressure from the hydraulic interval adjustment device.

An adjustment screw may be penetratively inserted and engaged into a front end portion of the extension portion.

The hydraulic interval adjustment device may include a first hydraulic chamber formed in the first rocker arm, a hydraulic piston installed in the first hydraulic chamber and capable of being moved forward and backward, a stopper ring installed in the first hydraulic chamber to limit a forward stroke of the hydraulic piston, and a hydraulic pressure supply passage formed to supply a hydraulic pressure to the first hydraulic chamber.

The hydraulic piston may include a piston shaft formed in a substantially circular shape, a first piston flange formed on one side front end portion of the piston shaft to serve as a pressure receiving surface for receiving the hydraulic pressure and having a diameter larger than a diameter of the piston shaft, and a second piston flange spaced apart from the first piston flange at a predetermined interval along an axial direction of the piston shaft so that a lock groove is formed between the first piston flange and the second piston flange, and having a diameter larger than the diameter of the piston shaft.

The hydraulic interval maintaining device may include a lock pin capable of being inserted into the lock groove by the hydraulic pressure through the hydraulic pressure supply passage, and configured to maintain a forward movement state of the hydraulic piston, wherein the lock pin includes a lock pin body having a substantially cylindrical shape, two protruding portions formed on one side surface of the lock pin body in a longitudinal direction of the lock pin body and separated in a diameter direction, and a hydraulic pressure acting groove formed between the two protruding portions, and wherein the hydraulic pressure acts on the hydraulic pressure acting groove, and a return spring configured to apply a return restoring force to the lock pin, wherein the return spring is fitted with an outer circumference of the lock pin.

A second hydraulic chamber may be formed in the first rocker arm to be communicated with the first hydraulic chamber and supplied with the hydraulic pressure through the hydraulic pressure supply passage, the lock pin and the return spring may be installed to be inserted into the second hydraulic chamber, and a cap may be installed to seal the second hydraulic chamber from an outside.

A piston acting groove may be formed in the second rocker arm so that the hydraulic piston applies a pressure to the piston acting groove by being inserted into the piston acting groove.

Various other aspects of the present invention provides a valve apparatus for a vehicle engine. The valve apparatus may include a valve configured to open and close a combustion chamber, a cam having a predetermined cam profile and configured to be rotated by receiving a power generated in the combustion chamber, a cam side rocker arm installed to be turned by receiving a rotational motion from the cam, a rocker shaft penetratively mounted into the cam side rocker arm, a valve side rocker arm installed on the rocker shaft to apply a pressure for opening the valve while being turned by receiving a turning motion force from the cam side rocker arm, a hydraulic interval adjustment device installed in the cam side rocker arm to adjust an interval between the cam side rocker arm and the valve side rocker arm, and a hydraulic interval maintaining device configured to maintain the interval between the cam side rocker arm and the valve side rocker arm adjusted by the hydraulic interval adjustment device.

The cam side rocker arm may include an upper body having a substantially quadrangular block shape, two flanges integrally formed and extended downwardly from the upper body and spaced apart from each other at a predetermined interval to form an assembly space, a roller inserted into the assembly space and rotatably mounted in the two flanges, and two assembly portions integrally formed and extended downwardly from the upper body, wherein the turning center shaft penetratively fits into the two assembly portions. The valve side rocker arm may include an arm body having an assembly hole for penetratively fitting the turning center shaft into the assembly hole, an extension portion integrally formed and extended outwardly from the arm body in a crossing direction, and a pressure receiving portion having a substantially quadrangular block shape and formed on an upper portion of the extension portion to receive a pressure from the hydraulic interval adjustment device.

An adjustment screw configured to press the valve may be penetratively inserted and engaged into a front end portion of the extension portion.

The hydraulic interval adjustment device may include a first hydraulic chamber formed in the cam side rocker arm, a hydraulic piston installed in the first hydraulic chamber and capable of being moved forward and backward, a stopper ring installed in the first hydraulic chamber to limit a forward stroke of the hydraulic piston, and a hydraulic pressure supply passage formed to supply a hydraulic pressure to the first hydraulic chamber.

The hydraulic piston may include a piston shaft formed in a substantially circular shape, a first piston flange formed on one side front end portion of the piston shaft to serve as a pressure receiving surface for receiving the hydraulic pressure and having a diameter larger than a diameter of the piston shaft, and a second piston flange spaced apart from the first piston flange at a predetermined interval along an axial direction of the piston shaft so that a lock groove is formed between the first piston flange and the second piston flange, and having a diameter larger than the diameter of the piston shaft.

The hydraulic interval maintaining device may include a lock pin capable of being inserted into the lock groove by the hydraulic pressure through the hydraulic pressure supply passage, and configured to maintain a forward movement state of the hydraulic piston, and a return spring fitted with an outer circumference of the lock pin to apply a return restoring force to the lock pin.

The lock pin may include a lock pin body having a substantially cylindrical shape, two protruding portions formed on one side surface of the lock pin body in a longitudinal direction of the lock pin body and separated in a diameter direction, and a hydraulic pressure acting groove formed between the two protruding portions and on which the hydraulic pressure acts.

A second hydraulic chamber may be formed in the cam side rocker arm to be communicated with the first hydraulic chamber and supplied with the hydraulic pressure through the hydraulic pressure supply passage, the lock pin and the return spring are installed to be inserted into the second hydraulic chamber, and a piston acting groove is formed in the valve side rocker arm so that the hydraulic piston applies a pressure to the piston acting groove by being inserted into the piston acting groove.

According to the variable valve lift device and the valve apparatus for a vehicle engine using the same of the present invention, a high lift mode and a low lift mode of a valve are smoothly implemented by the cam side rocker arm rotated about the rocker shaft by the cam, the valve side rocker arm configured to adjust a valve lift while being rotated about the rocker shaft, and the hydraulic interval adjustment device installed in the cam side rocker arm and configured to rotate the valve side rocker arm by being operated by hydraulic pressure, and as a result, fuel efficiency of an engine may be improved, and output of an engine may be increased.

As the piston of the hydraulic interval adjustment device is maintained by the lock pin in a state in which the piston is moved forward by being operated by hydraulic pressure, an operation of the high lift mode is stably maintained, thereby improving operational reliability.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
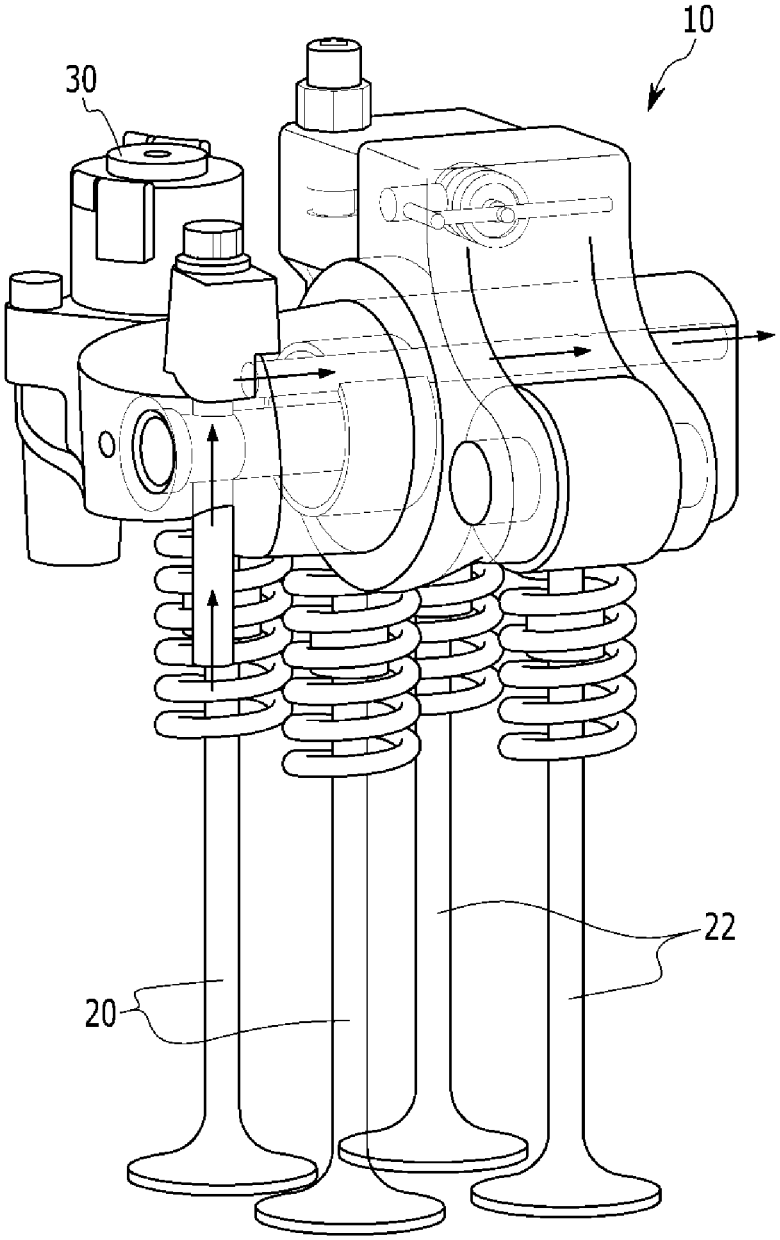
FIG. 1 is a perspective view of an exemplary valve apparatus for a vehicle engine including a variable valve lift device according to the present invention.

Referring to FIG. 1, a variable valve lift device 10 according to various embodiments of the present invention may adjust a valve lift of an intake valve 20 or an exhaust valve 22, which opens and closes a combustion chamber of an engine, or may adjust valve lifts of the entire intake and exhaust valves 20 and 22. The variable valve lift device 10 is configured to adjust the valve lift while being operated by being supplied with hydraulic pressure, as indicated by the arrow, through a hydraulic pressure supply source which is not illustrated.

A solenoid valve may be included as a control valve 30 configured to control opening and closing operations of a supply flow path of hydraulic pressure which is supplied to the variable valve lift device 10 through the hydraulic pressure supply source, and an operation of the solenoid valve is controlled by a controller which is not illustrated.

Figure 2:
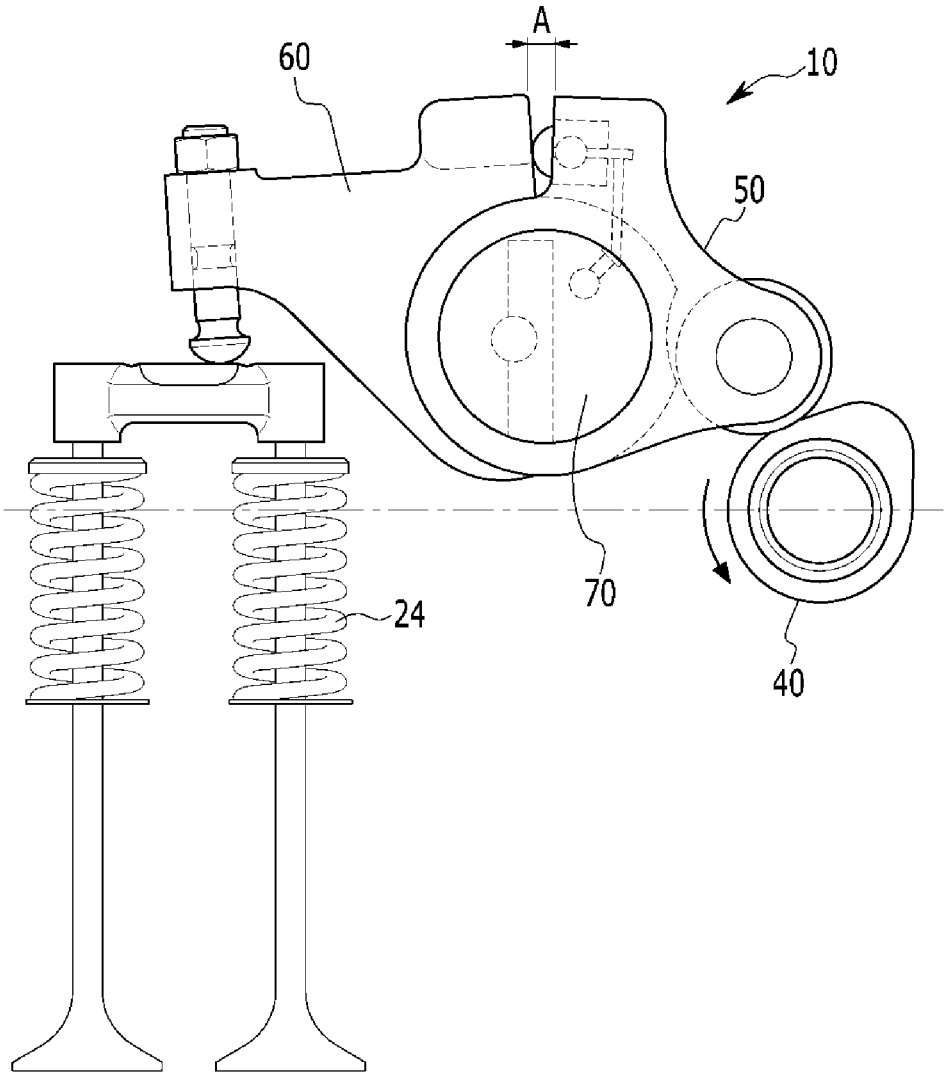
FIG. 2 is a side view implementing a high lift mode with an exemplary variable valve lift device according to the present invention.

Referring to FIG. 2, a state is illustrated in which the intake valve 20 is converted into a high lift mode (HLM) by the variable valve lift device 10. The variable valve lift device 10 transmits rotational motion of a cam 40 having a predetermined cam profile to the intake valve 20, and the intake valve 20 opens and closes an intake port formed in the combustion chamber while being moved up and down by pressure transmitted from the variable valve lift device 10 and elastic force of a spring 24.

The variable valve lift device 10 includes a cam side rocker arm 50 as a first rocker arm installed to be in contact with the cam 40 to receive the rotational motion of the cam 40, and a valve side rocker arm 60 as a second rocker arm disposed toward the intake valve to adjust the valve lift of the intake valve 20.

The cam side rocker arm 50 and the valve side rocker arm 60 are assembled to a rocker shaft 70, respectively. That is, as the rocker shaft 70 is penetratively fitted into each of the cam side rocker arm 50 and the valve side rocker arm 60, the cam side rocker arm 50 and the valve side rocker arm 60 are turned about the rocker shaft 70 in a clockwise direction or a counterclockwise direction.

Figure 3:
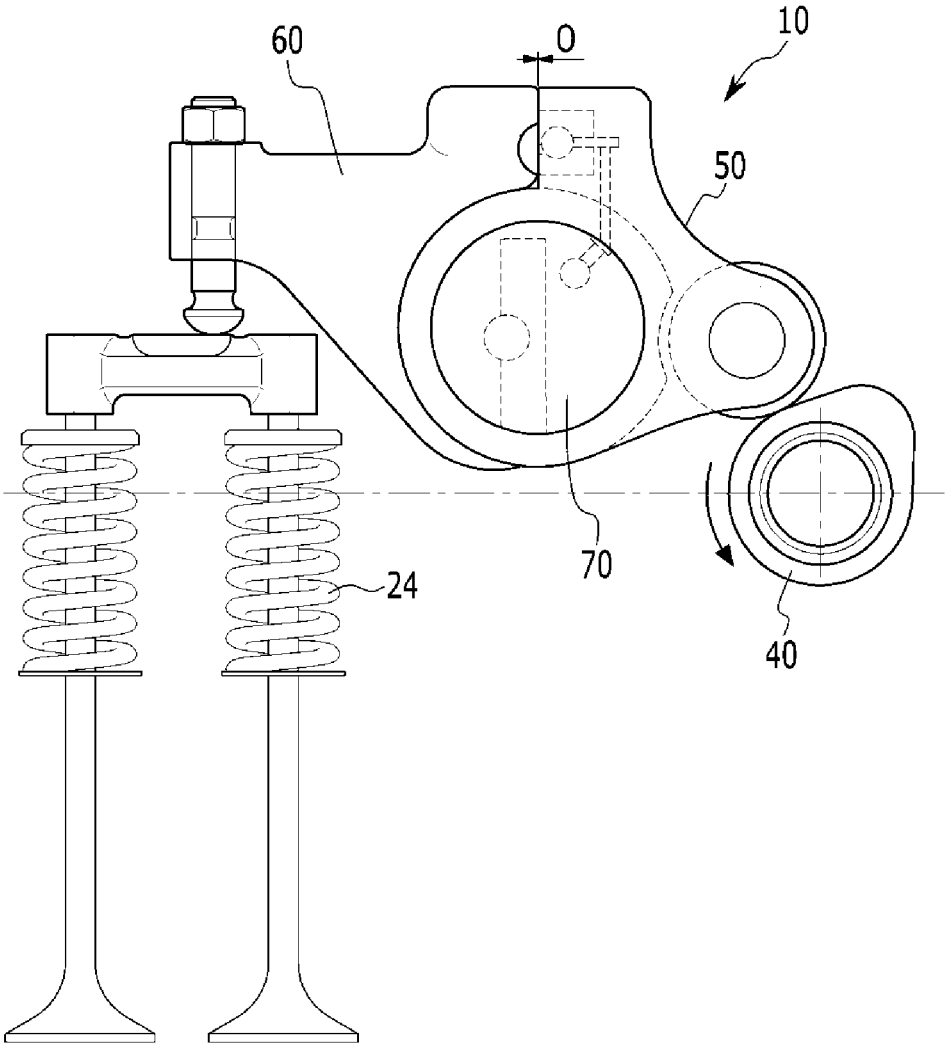
FIG. 3 is a side view implementing a low lift mode with an exemplary variable valve lift device according to the present invention.

The rocker shaft 70 forms a turning center shaft of the cam side rocker arm 50 and the valve side rocker arm 60. When an upper portion of the valve side rocker arm 60 is spaced apart from an upper portion of the cam side rocker arm 50 at a predetermined interval A based on the rocker shaft 70, a high lift mode is implemented. Referring to FIG. 3, when the upper portion of the valve side rocker arm 60 comes into close contact with the upper portion of the cam side rocker arm 50, a low lift mode (LLM) is implemented.

In FIGS. 2 and 3, the operation in which the high lift mode is implemented when the valve side rocker arm 60 is spaced apart from the cam side rocker arm 50, or the operation in which the low lift mode is implemented when the valve side rocker arm 60 comes into close contact with the cam side rocker arm 50 is performed by a hydraulic interval adjustment device which will be described below.

Figure 4:
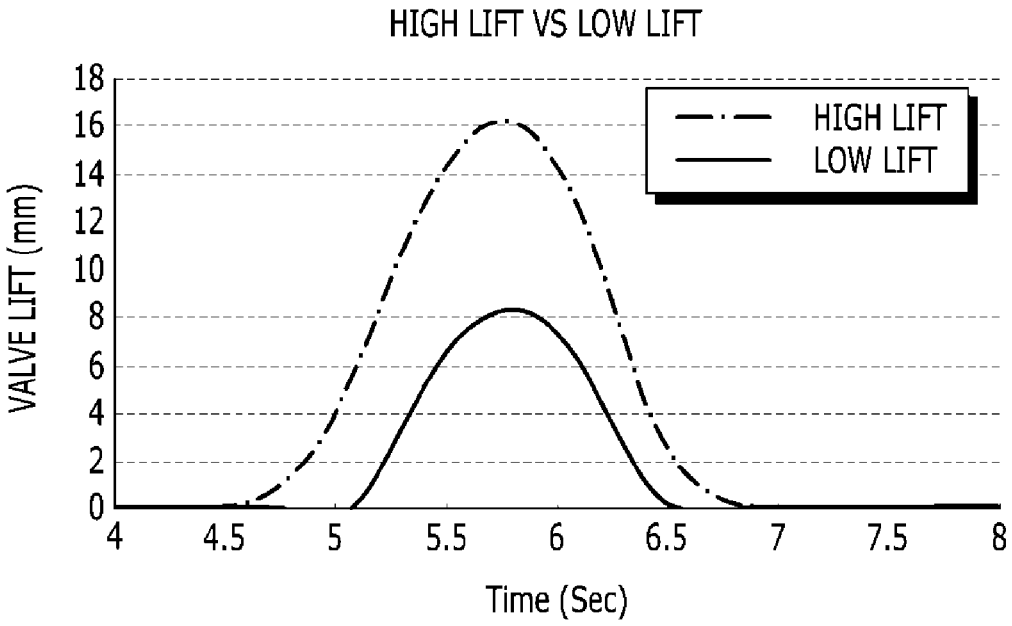
FIG. 4 is a graph implementing the high lift mode and the low lift mode with an exemplary variable valve lift device according to the present invention.

Referring to FIG. 4, a maximum valve lift amount in the high lift mode (HLM) is, for example, about 16 mm, and a maximum valve lift amount in the low lift mode (LLM) is, for example, about 8 mm.

Figure 5:
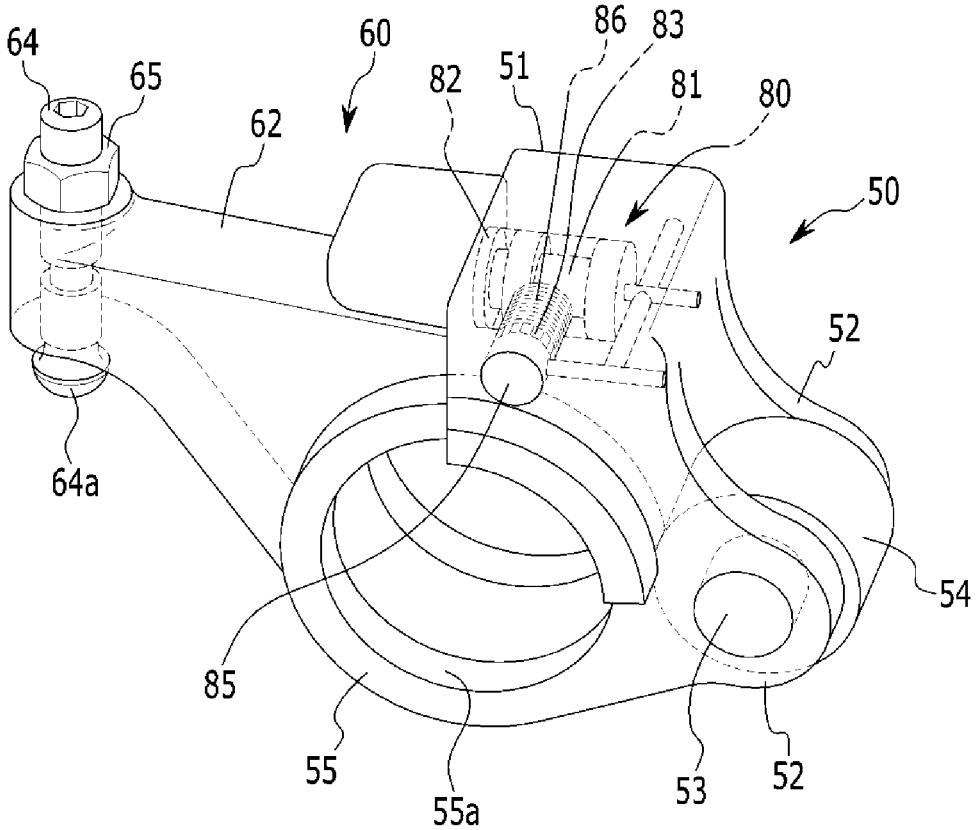
FIG. 5 is an assembled perspective view of a rocker arm of an exemplary variable valve lift device according to the present invention.
Figure 6:
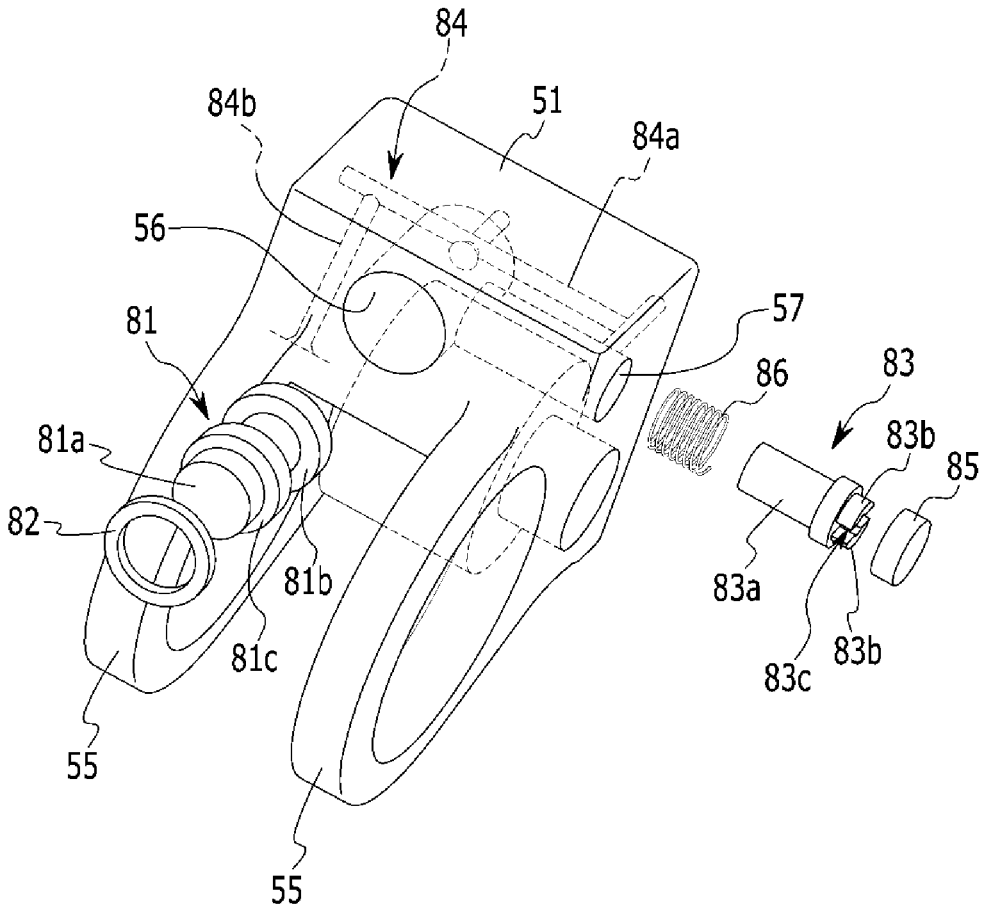
FIG. 6 is a perspective view of a cam side rocker arm of an exemplary variable valve lift device according to the present invention.

Referring to FIGS. 5 and 6, the cam side rocker arm 50 includes an upper body 51 having an approximately or substantially quadrangular block shape. Two flanges 52 are formed to be integrally extended from the upper body 51 in a downward direction and one direction. One will appreciate that such integral components may be monolithically formed. The two flanges 52 are disposed to be spaced apart from each other at a predetermined interval to have an assembly space formed therebetween, and a roller 53 is mounted in the assembly space to be rotatable through a roller shaft 54. The roller 53 comes into contact with the cam 40, and receives the rotational motion of the cam 40.

Two assembly portions 55 having assembly holes 55*a* formed in an approximately or substantially circular shape are formed to be integrally extended from the upper body 51 in a downward direction and the other direction. One will appreciate that such integral components may be monolithically formed.

The two assembly portions 55 are formed to be disposed at a predetermined interval or distance. The rocker shaft 70 is assembled by being fitted into each of the assembly holes 55*a* of the two assembly portions 55. Accordingly, the cam side rocker arm 50 is supported to be turned about the rocker shaft 70 in a clockwise direction or a counterclockwise direction.

The hydraulic interval adjustment device 80 is installed in the upper body 51. The hydraulic interval adjustment device 80 includes a hydraulic piston 81 installed in a first hydraulic chamber 56 formed in the upper body 51 to be capable of being moved forward and backward, a stopper ring 82 installed in the first hydraulic chamber 56 to limit a forward stroke of the hydraulic piston 81, and a hydraulic pressure supply passage 84 formed to supply hydraulic pressure to the first hydraulic chamber 56. A lock pin 83 may be further included as a hydraulic interval maintaining device which selectively locks and releases the hydraulic piston 81.

The hydraulic piston 81 includes a piston shaft 81*a* formed in an approximately or substantially circular shape, and two piston flanges 81*b* and 81*c* disposed at a predetermined interval along an axial direction of the piston shaft 81 and having a diameter larger than a diameter of the piston shaft 81.

The first piston flange 81*b* serves as a pressure receiving surface which is supplied with hydraulic pressure flowing into the first hydraulic chamber 56, and the second piston flange 81*c* is disposed to be spaced apart from the first piston flange 81*b* in an axial direction and serves to form therebetween a lock groove in which the lock pin 83 is inserted and locked.

Figure 8:
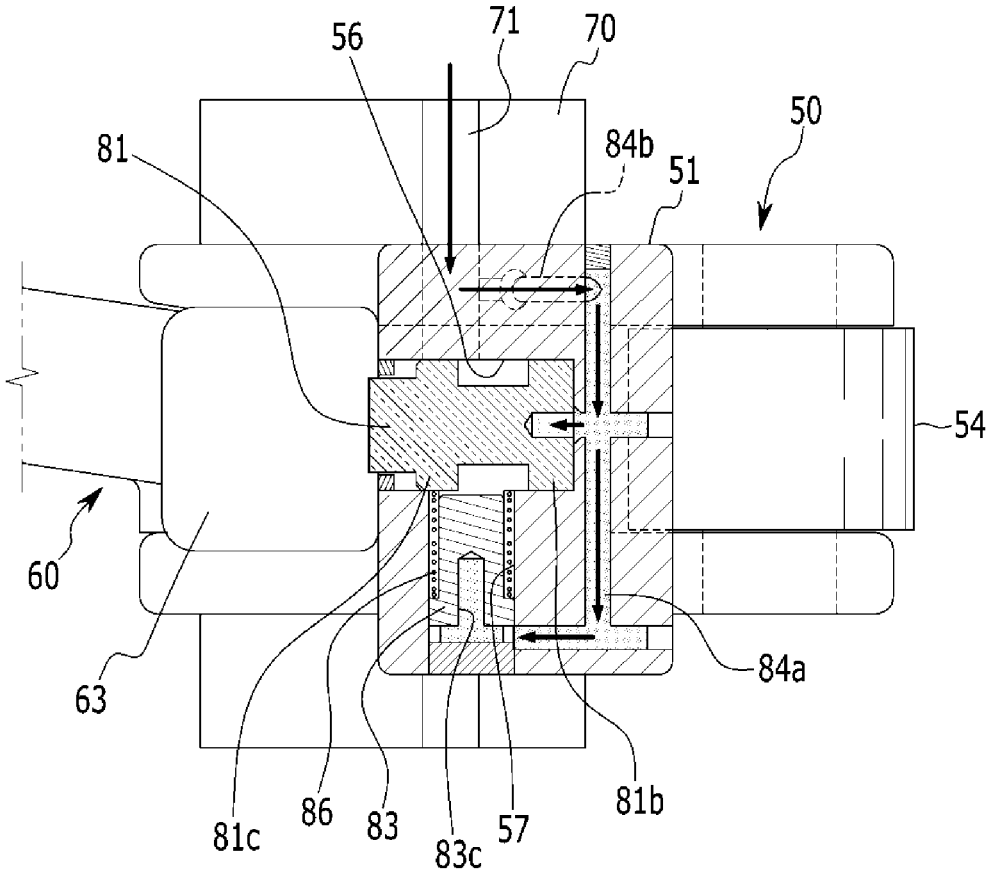
FIG. 8 is a cross-sectional view implementing the low lift mode with an exemplary variable valve lift device according to the present invention.

The lock pin 83 includes a lock pin body 83*a* having a cylindrical shape, two protruding portions 83*b* formed on one side surface of the lock pin body 83*a* in a longitudinal direction of the lock pin body 83*a* to be separated in a diameter direction, and a hydraulic pressure acting groove 83*c* formed between the two protruding portions 83*b* and on which the inflow hydraulic pressure acts. As illustrated in FIG. 8, the hydraulic pressure acting groove 83*c* may be formed to be inwardly extended along the longitudinal direction of the lock pin body 83*a*.

A second hydraulic chamber 57 is formed in the upper body 51 in a direction substantially perpendicular to the first hydraulic chamber 56. The second hydraulic chamber 57 is formed to be communicated with the first hydraulic chamber 56.

The lock pin 83 is installed to be movable forward and backward by being inserted into the second hydraulic chamber 57, a return spring 86, configured to move again the lock pin 83 backward in a case in which hydraulic pressure having acted on the lock pin 83 is dissipated after the lock pin 83 is moved forward by the hydraulic pressure, is installed to be fitted with an outer circumference of the lock pin 83, and a cap 85 is installed in order to seal the second hydraulic chamber 57 from the outside.

The hydraulic pressure supply passage 84 includes a main passage 84*a* formed to be communicated with each of the first hydraulic chamber 56 and the second hydraulic chamber 57 to supply hydraulic pressure to the first hydraulic chamber 56 and the second hydraulic chamber 57, and a connecting passage 84*b* branched from the main passage 84*a* in a substantially perpendicular direction.

As illustrated in FIG. 8, the connecting passage 84*b* is connected to and communicated with a hydraulic pressure supply passage 71 formed in the rocker shaft 70.

The hydraulic pressure supply passage 71 of the rocker shaft 70 is connected to be supplied with hydraulic pressure from a hydraulic pressure supply source which is not illustrated.

Figure 7:
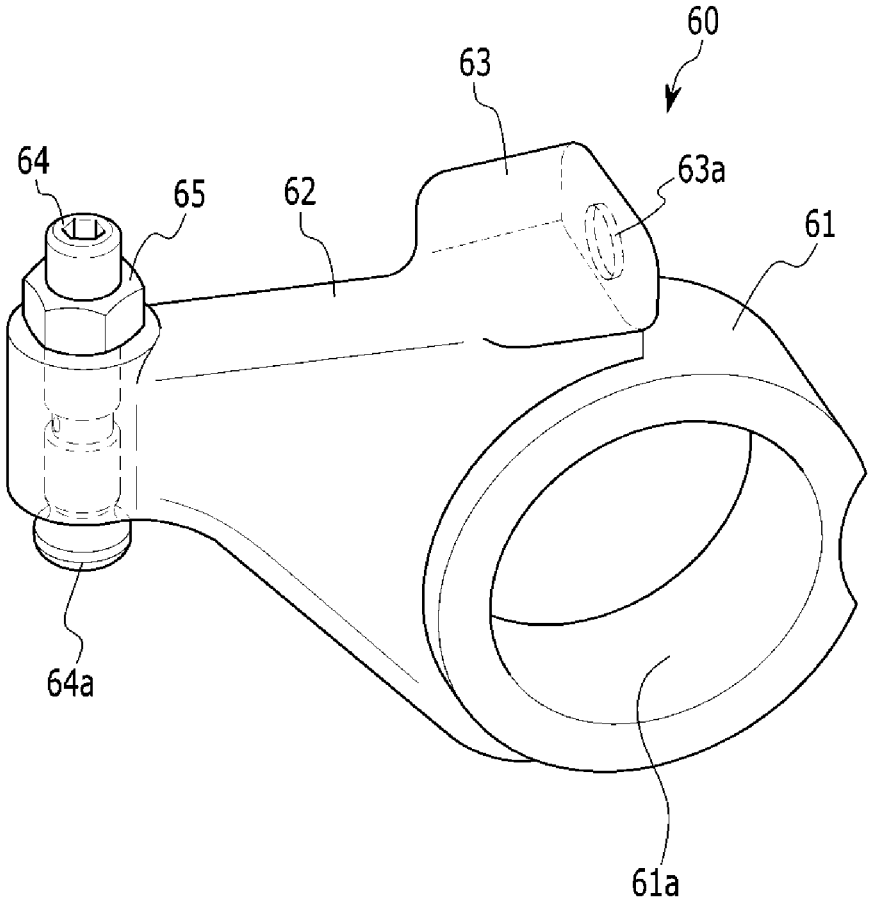
FIG. 7 is a perspective view of a valve side rocker arm of an exemplary variable valve lift device according to the present invention.

Referring to FIGS. 5 and 7, the cam side rocker arm 60 includes an arm body 61 having a circular assembly hole 61*a* so that the rocker shaft 70 is penetratively fitted into the circular assembly hole 61*a*, an extension portion 62 formed to be integrally and outwardly extended from the arm body 61 in a diameter or crossing direction, and a pressure receiving portion 63 formed on an upper portion of the extension portion 62 and having an approximately or substantially quadrangular block shape. One will appreciate that such integral components may be monolithically formed.

In the pressure receiving portion 63, a piston acting groove 63*a* having an inwardly concave shape is formed in an opposite surface which is oriented toward the upper body 51 of the cam side rocker arm 50, and the piston 81 of the hydraulic interval adjustment device 80 pushes the valve side rocker arm 60 while moving forward, outwardly protruding from the upper body 51, and being inserted into the piston acting groove 63*a*.

An adjustment screw 64 is penetratively inserted into a front end portion of the extension portion 62, and engaged with a nut 65. As illustrated in FIGS. 2 and 3, a head portion 64*a* of the adjustment screw 64 is installed to be in direct contact with an upper portion of the intake valve 20, and serves to open the intake valve 20 by directly applying pressure on the intake valve 20. If an extent of engagement of the adjustment screw 64 to the valve side rocker arm 60 is adjusted, the valve lift of the intake valve 20 may be manually adjusted.

FIG. 8 illustrates an operational state when the variable valve lift device 10 according to various embodiments of the present invention implements the low lift mode. When the low lift mode is implemented, the pressure receiving portion 63 of the valve side rocker arm 60 maintains a state of being in close contact with the upper body 51 of the cam side rocker arm 50.

When the cam 40 is rotated in a state in which the valve side rocker arm 60 and the cam side rocker arm 50 are in close contact with each other, as described above, as the rotational motion of cam 40 is transmitted to the cam side rocker arm 50 through the roller 54, the cam side rocker arm 50 is turned about the rocker shaft 70 in clockwise and counterclockwise directions, and as the turning motion of the cam side rocker arm 50 is transmitted to the pressure receiving portion 63 of the valve side rocker arm 60, which is in close contact with the cam side rocker arm 50, the valve side rocker arm 60 is also turned about the rocker shaft 70 in clockwise and counterclockwise direction, thereby opening and closing the intake valve 20.

Meanwhile, when the high lift mode is implemented, hydraulic pressure is supplied from the hydraulic pressure supply source to each of the first hydraulic chamber 56 and the second hydraulic chamber 57 through the hydraulic pressure supply passage 71 of the rocker shaft 70 via the connecting passage 84*a* and the main passage 84*a* of the cam side rocker arm 50.

Figure 9:
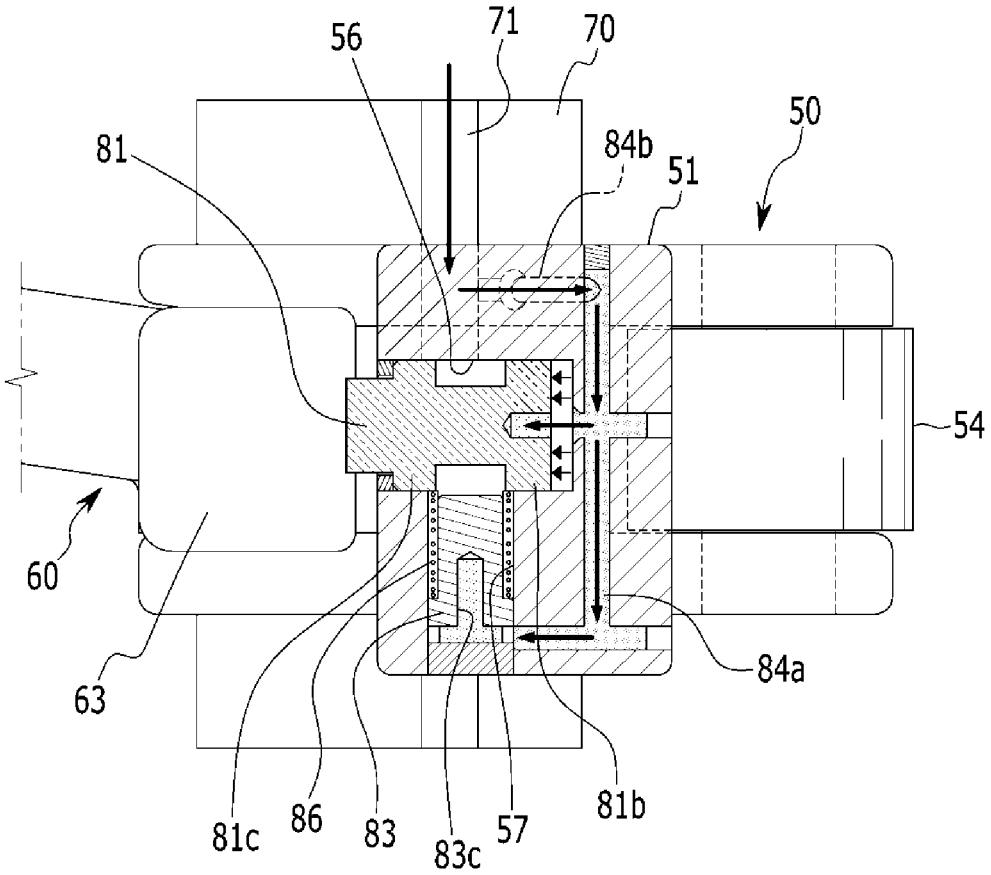
FIG. 9 is a cross-sectional view implementing an initial state of the high lift mode with an exemplary variable valve lift device according to the present invention.

When hydraulic pressure is supplied to each of the hydraulic chambers as described above, as illustrated in FIG. 9, the hydraulic piston 81 is moved forward by the hydraulic pressure supplied to the first hydraulic chamber 56, and then is inserted into the piston acting groove 63*a* formed in the pressure receiving portion 63 of the valve side rocker arm 60, thereby pushing the valve side rocker arm 60 in a counterclockwise direction.

Figure 10:
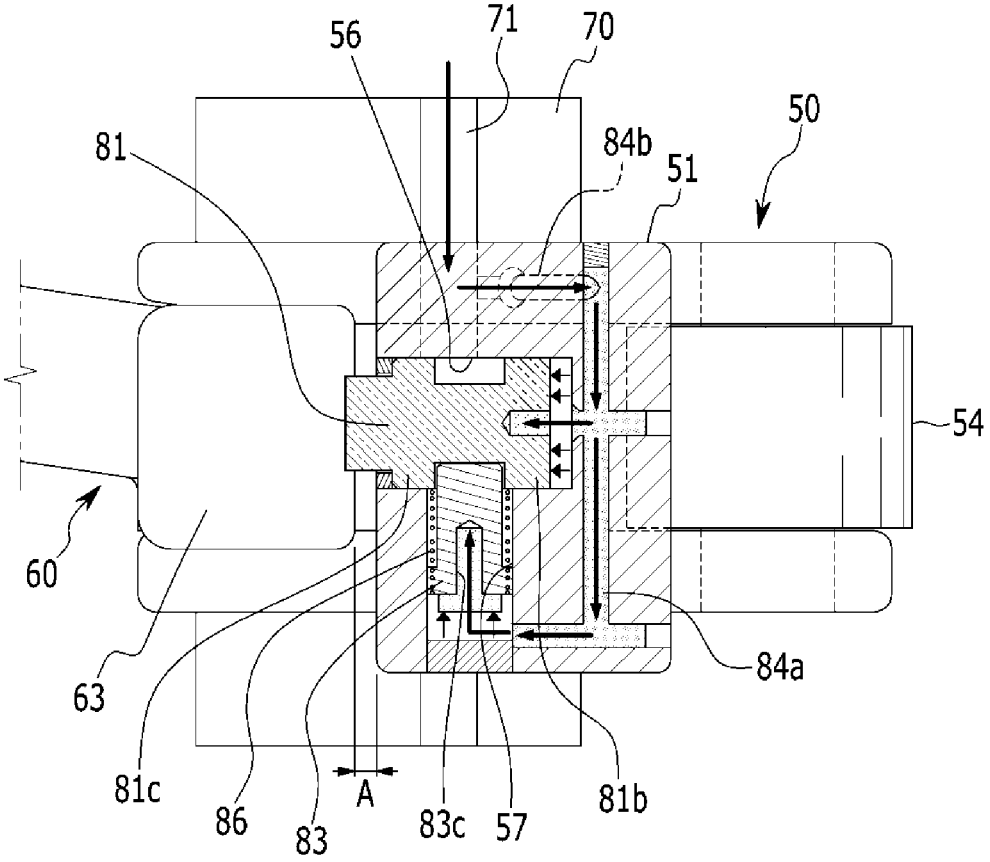
FIG. 10 is a cross-sectional view implementing the high lift mode with an exemplary variable valve lift device according to the present invention.

In addition, as illustrated in FIG. 10, as the hydraulic pressure supplied to the second hydraulic chamber 57 acts on the hydraulic pressure acting groove 83*c* of the lock pin 83 to push the lock pin 83, the lock pin 83 is moved forward by the hydraulic pressure, and inserted into the lock groove formed between the two piston flanges 81*b* and 81*c* of the hydraulic piston 81, thereby maintaining the forward movement state of the lock pin 83. Therefore, the high lift mode is stably maintained by the lock pin 83 locked by the hydraulic piston 81 which has been moved forward.

In the high lift mode, the pressure receiving portion 63 of the valve side rocker arm 60 is spaced apart from the upper body 51 of the cam side rocker arm 50 by a forward stroke of the hydraulic piston 81.

Figure 11:
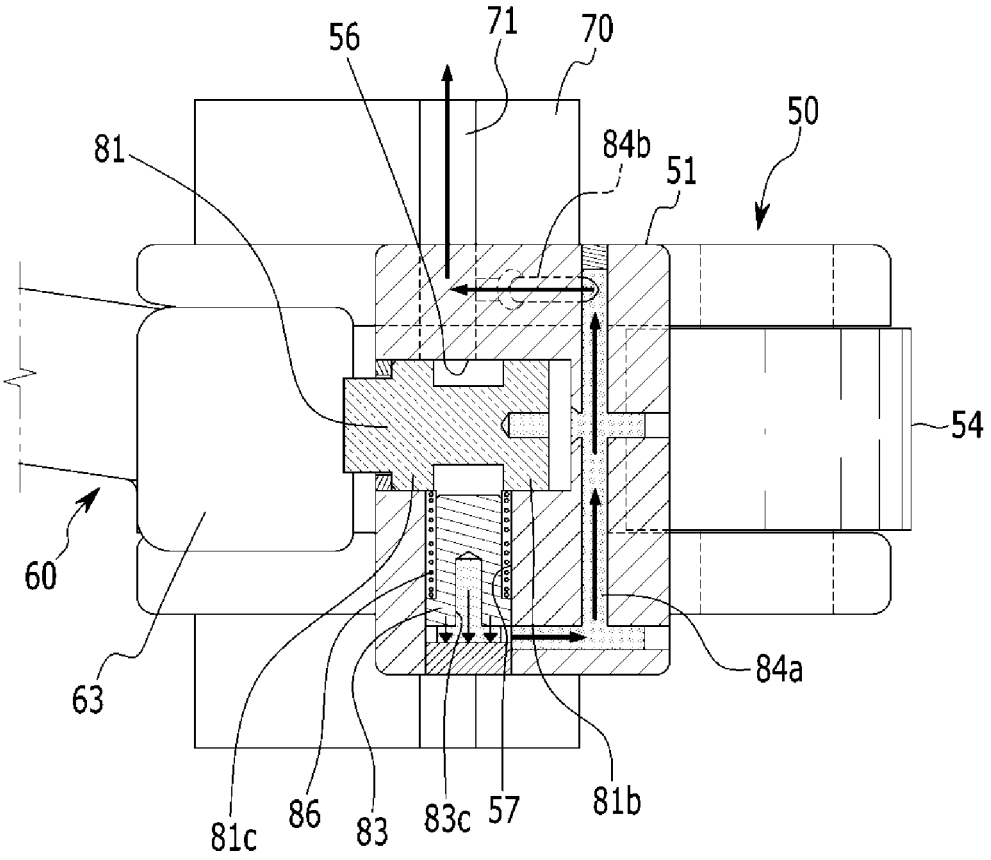
FIG. 11 is a cross-sectional view explaining a state in which the high lift mode is converted into the low lift mode with an exemplary variable valve lift device according to the present invention.

Meanwhile, in a case in which the high lift mode is converted back into the low lift mode, as illustrated in FIG. 11, when the hydraulic pressure supplied to the first and second hydraulic chambers 56 and 57 is drained again, the lock pin 83 is moved away from the lock groove of the hydraulic piston 81 by elastic restoring force of the return spring 86, and the hydraulic piston 81 is released from the lock pin 83. In this state, as the hydraulic pressure having acted on the hydraulic piston 81 is dissipated, the hydraulic piston 81 is naturally returned back to an original position, and as a result, the high lift mode is converted into the low lift mode illustrated in FIG. 8.

For convenience in explanation and accurate definition in the appended claims, the terms "upper" or "lower", "inwardly" or "outwardly" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift device comprising:

a first rocker arm coupled to a turning center shaft and rotatable about the turning center shaft;

a second rocker arm coupled to the turning center shaft and rotatable about the turning center shaft;

a hydraulic interval adjustment device installed in the first rocker arm to adjust an interval between the first and second rocker arms; and a hydraulic interval maintaining device configured to maintain the interval between the first and second rocker arms adjusted by the hydraulic interval adjustment device, wherein the hydraulic interval adjustment device includes:

a first hydraulic chamber formed in the first rocker arm;

a hydraulic piston installed in the first hydraulic chamber and capable of being moved forward and backward;

a stopper ring installed in the first hydraulic chamber to limit a forward stroke of the hydraulic piston; and a hydraulic pressure supply passage formed to supply a hydraulic pressure to the first hydraulic chamber, and wherein the hydraulic piston includes:

a piston shaft formed in a substantially circular shape;

a first piston flange formed on one side front end portion of the piston shaft to serve as a pressure receiving surface for receiving the hydraulic pressure and having a diameter larger than a diameter of the piston shaft; and a second piston flange spaced apart from the first piston flange at a predetermined interval along an axial direction of the piston shaft so that a lock groove is formed between the first piston flange and the second piston flange, and having a diameter larger than the diameter of the piston shaft.

2. The variable valve lift device of claim 1, wherein the first rocker arm includes:

an upper body having a substantially quadrangular block shape;

two flanges integrally formed and extended downwardly from the upper body and spaced apart from each other at a predetermined interval to form an assembly space;

a roller inserted into the assembly space and rotatably mounted in the two flanges; and two assembly portions integrally formed and extended downwardly from the upper body, wherein the turning center shaft penetratively fits into the two assembly portions.

3. The variable valve lift device of claim 1, wherein the second rocker arm includes:

an arm body having an assembly hole for penetratively fitting the turning center shaft into the assembly hole;

an extension portion integrally formed and extended outwardly from the arm body in a crossing direction; and a pressure receiving portion having a substantially quadrangular block shape and formed on an upper portion of the extension portion to receive a pressure from the hydraulic interval adjustment device.

4. The variable valve lift device of claim 3, wherein an adjustment screw is penetratively inserted and engaged into a front end portion of the extension portion.

5. The variable valve lift device of claim 1, wherein the hydraulic interval maintaining device includes:

a lock pin capable of being inserted into the lock groove by the hydraulic pressure through the hydraulic pressure supply passage, and configured to maintain a forward movement state of the hydraulic piston, wherein the lock pin includes a lock pin body having a substantially cylindrical shape, two protruding portions formed on one side surface of the lock pin body in a longitudinal direction of the lock pin body and separated in a diameter direction, and a hydraulic pressure acting groove formed between the two protruding portions, and wherein the hydraulic pressure acts on the hydraulic pressure acting groove; and a return spring configured to apply a return restoring force to the lock pin, wherein the return spring is fitted with an outer circumference of the lock pin.

6. The variable valve lift device of claim 5, wherein:

a second hydraulic chamber is formed in the first rocker arm to be communicated with the first hydraulic chamber and supplied with the hydraulic pressure through the hydraulic pressure supply passage, the lock pin and the return spring are installed to be inserted into the second hydraulic chamber, and a cap is installed to seal the second hydraulic chamber from an outside.

7. The variable valve lift device of claim 1, wherein a piston acting groove is formed in the second rocker arm so that the hydraulic piston applies a pressure to the piston acting groove by being inserted into the piston acting groove.

8. A valve apparatus for a vehicle engine, comprising:

a valve configured to open and close a combustion chamber;

a cam having a predetermined cam profile and configured to be rotated by receiving a power generated in the combustion chamber;

a cam side rocker arm installed to be turned by receiving a rotational motion from the cam;

a rocker shaft penetratively mounted into the cam side rocker arm;

a valve side rocker arm installed on the rocker shaft to apply a pressure for opening the valve while being turned by receiving a turning motion force from the cam side rocker arm;

a hydraulic interval adjustment device installed in the cam side rocker arm to adjust an interval between the cam side rocker arm and the valve side rocker arm; and a hydraulic interval maintaining device configured to maintain the interval between the cam side rocker arm and the valve side rocker arm adjusted by the hydraulic interval adjustment device, wherein the hydraulic interval adjustment device includes:

a first hydraulic chamber formed in the cam side rocker arm;

a hydraulic piston installed in the first hydraulic chamber and capable of being moved forward and backward;

a stopper ring installed in the first hydraulic chamber to limit a forward stroke of the hydraulic piston; and a hydraulic pressure supply passage formed to supply a hydraulic pressure to the first hydraulic chamber, and wherein the hydraulic piston includes:

a piston shaft formed in a substantially circular shape;

a first piston flange formed on one side front end portion of the piston shaft to serve as a pressure receiving surface for receiving the hydraulic pressure and having a diameter larger than a diameter of the piston shaft; and a second piston flange spaced apart from the first piston flange at a predetermined interval along an axial direction of the piston shaft so that a lock groove is formed between the first piston flange and the second piston flange, and having a diameter larger than the diameter of the piston shaft.

9. The valve apparatus of claim 8, wherein the cam side rocker arm includes:

an upper body having a substantially quadrangular block shape;

two flanges integrally formed and extended downwardly from the upper body and spaced apart from each other at a predetermined interval to form an assembly space;

a roller inserted into the assembly space and rotatably mounted in the two flanges; and two assembly portions integrally formed and extended downwardly from the upper body, wherein the turning center shaft penetratively fits into the two assembly portions; and the valve side rocker arm includes:

an arm body having an assembly hole for penetratively fitting the turning center shaft into the assembly hole;

an extension portion integrally formed and extended outwardly from the arm body in a crossing direction; and a pressure receiving portion having a substantially quadrangular block shape and formed on an upper portion of the extension portion to receive a pressure from the hydraulic interval adjustment device.

10. The valve apparatus of claim 9, wherein an adjustment screw configured to press the valve is penetratively inserted and engaged into a front end portion of the extension portion.

11. The valve apparatus of claim 8, wherein the hydraulic interval maintaining device includes:

a lock pin capable of being inserted into the lock groove by the hydraulic pressure through the hydraulic pressure supply passage, and configured to maintain a forward movement state of the hydraulic piston; and a return spring fitted with an outer circumference of the lock pin to apply a return restoring force to the lock pin.

12. The valve apparatus of claim 11, wherein the lock pin includes:

a lock pin body having a substantially cylindrical shape;

two protruding portions formed on one side surface of the lock pin body in a longitudinal direction of the lock pin body and separated in a diameter direction; and a hydraulic pressure acting groove formed between the two protruding portions and on which the hydraulic pressure acts.

13. The valve apparatus of claim 8, wherein:

a second hydraulic chamber is formed in the cam side rocker arm to be communicated with the first hydraulic chamber and supplied with the hydraulic pressure through the hydraulic pressure supply passage, the lock pin and the return spring are installed to be inserted into the second hydraulic chamber, and a piston acting groove is formed in the valve side rocker arm so that the hydraulic piston applies a pressure to the piston acting groove by being inserted into the piston acting groove.

14. A valve apparatus for a vehicle engine, comprising:

a valve configured to open and close a combustion chamber;

a cam having a predetermined cam profile and configured to be rotated by receiving a power generated in the combustion chamber;

a cam side rocker arm installed to be turned by receiving a rotational motion from the cam;

a rocker shaft penetratively mounted into the cam side rocker arm;

a valve side rocker arm installed on the rocker shaft to apply a pressure for opening the valve while being turned by receiving a turning motion force from the cam side rocker arm;

a hydraulic interval adjustment device installed in the cam side rocker arm to adjust an interval between the cam side rocker arm and the valve side rocker arm; and a hydraulic interval maintaining device configured to maintain the interval between the cam side rocker arm and the valve side rocker arm adjusted by the hydraulic interval adjustment device, wherein the hydraulic interval adjustment device includes:

a first hydraulic chamber formed in the cam side rocker arm;

a hydraulic piston installed in the first hydraulic chamber and capable of being moved forward and backward;

a stopper ring installed in the first hydraulic chamber to limit a forward stroke of the hydraulic piston; and a hydraulic pressure supply passage formed to supply a hydraulic pressure to the first hydraulic chamber, and wherein a second hydraulic chamber is formed in the cam side rocker arm to be communicated with the first hydraulic chamber and supplied with the hydraulic pressure through the hydraulic pressure supply passage, the lock pin and the return spring are installed to be inserted into the second hydraulic chamber, and a piston acting groove is formed in the valve side rocker arm so that the hydraulic piston applies a pressure to the piston acting groove by being inserted into the piston acting groove.

* * * * *